United States Patent [19]

Hernandez

[11] Patent Number: 4,742,734

[45] Date of Patent: May 10, 1988

[54] BOTTLE OPENER

[76] Inventor: Albert Hernandez, 465 Ocean Pkwy., Apt. 1-H, Brooklyn, N.Y. 11218

[21] Appl. No.: 77,666

[22] Filed: Jul. 24, 1987

[51] Int. Cl.[4] ..... B67B 7/18

[52] U.S. Cl. ..... 81/3.4; 81/3.09

[58] Field of Search ..... 81/3.07, 3.4, 3.29, 81/3.42, 3.09; 7/151

[56] References Cited

U.S. PATENT DOCUMENTS 1,081,302 12/1913 Geddis ..... 81/3.4

1,647,892 11/1927 Viebrock ..... 81/3.4

FOREIGN PATENT DOCUMENTS 33508 8/1924 Denmark ..... 81/3.09

1551924 11/1968 France ..... 81/3.09

*Primary Examiner*—Roscoe V. Parker

*Attorney, Agent, or Firm*—Richard L. Miller

[57] ABSTRACT

This bottle opener is designed to remove screw caps off of beer bottles with little effort. Primarily, it consists of a base cap with left hand threads on the interior, for engagement with the outer threads of a screw cap on a filled bottle. It also is provided with a locking band in the top portion that locks a bottom end of an empty bottle in the device, so as to serve as a handle and also provide mechanical advantage for easy rotation to remove the screw cap from the filled bottle.

4 Claims, 1 Drawing Sheet

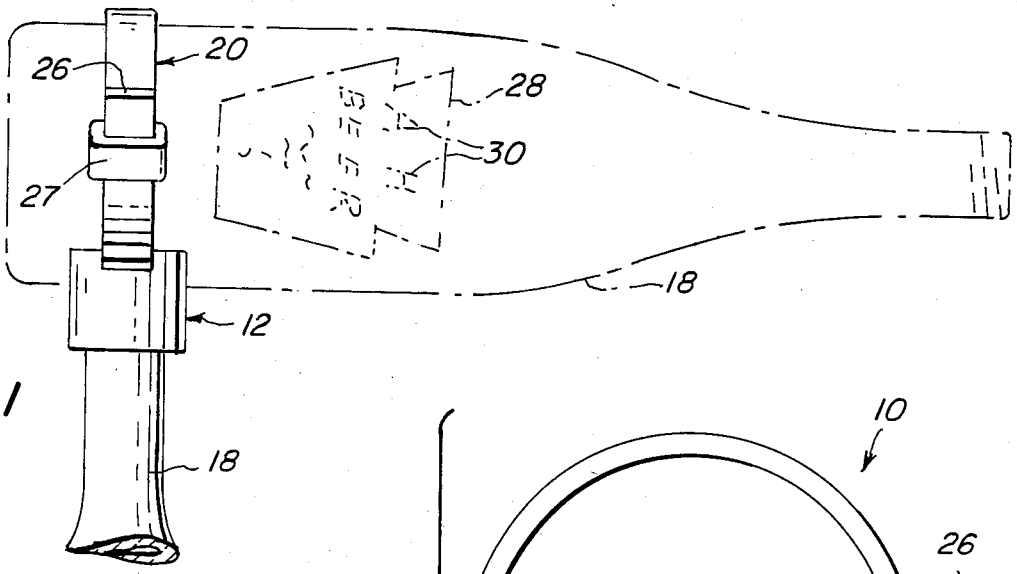
Fig. 1
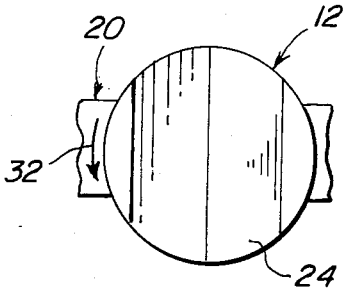
Fig. 3
Fig. 2
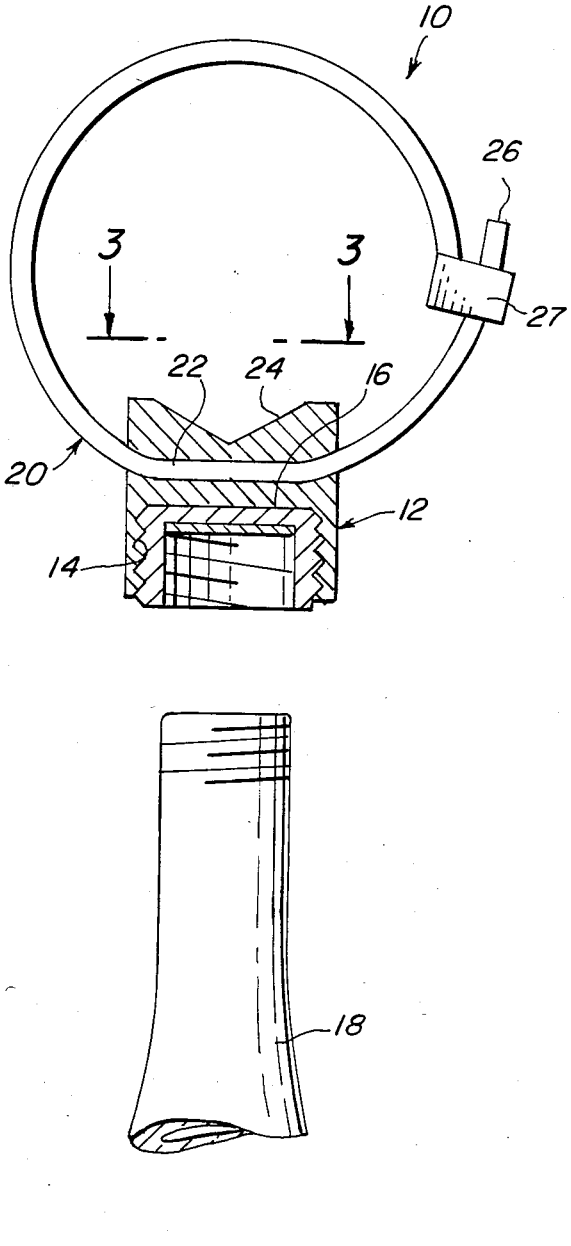

BOTTLE OPENER

BACKGROUND OF THE INVENTION

The instant invention relates generally to opening devices, and more particularly, to a bottle opener.

Numerous bottle openers have been provided in the prior art that are adapted to remove bottle caps. For example, U.S. Pat. Nos. 3,812,741 of Heine, 3,919,901 of Braman, 4,337,678 of Mumford, and 4,455,894 of Roberts, all are illustrative of such prior art. While these units may be suitable for the particular purpose to which they address, they would not be as suitable for the purpose of the present invention as hereafter described.

SUMMARY OF THE INVENTION

A primary object of the present invention is to provide a bottle opener that will overcome the shortcomings of the prior art devices.

Another object is to provide a bottle opener which will be unique in structure and will employ an empty bottle as a lever when it is used.

An additional object is to provide a bottle opener that will advertise a beverage brand name.

A further object is to provide a bottle opener that is simple and easy to use.

A still further object is to provide a bottle opener that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a side view of the instant invention, shown on a bottle cap of a fragmentary bottle, with an additional bottle for use as torque wrench illustrated.

FIG. 2 is an enlarged partial cross sectional view of the invention with a bottle cap therein that has been removed from a bottle.

FIG. 3 is a view taken along line 3—3 of FIG. 2.

DETAILED DESCRIPTION OF THE PREFERRED EMBODIMENTS

Turning now descriptively to the drawings, in which like reference characters denote like elements throughout the several views, a bottle opener device 10 is shown to include a base cap 12 having a left hand threaded opening 14 in its bottom, for reception of the outside threaded screw cap 16 of a filled beer bottle 18, so as to rotate screw cap 16 off of the bottle 18 in the normal counter clock-wise manner. A locking band 20 is provided and is received in a transverse opening 22 provided in the upper portion of base cap 12, for being received and locked tightly around the outer periphery of the bottom portion of another empty bottle 18. The outer periphery of the bottle 18 in the locking band 20 engages with recess 24 in the top surface of base cap 12, for lateral stability and when tightening locking band 20, its end 26 is pulled through the locking mechanism end 27.

The empty bottle 18 received in device 10 serves as a lever and handle for providing the necessary mechanical advantage for unscrewing the bottle screw cap 16 from the filled bottle 18, and the label 28 on the empty bottle 18 includes letter characters 30 naming a brand of beer, which when the device 10 is employed, will serve as a mental suggestion to the user, to buy more of the same beer.

In use, the empty bottle 18 of the device 10 is grasped in the hand of a user and the base cap 12 is threaded onto the bottle screw cap 16, as indicated by the arrow 32 imprinted on locking band 20. The rotation thereof in this counter clock-wise manner, will effectively unscrew the bottle screw cap 16 from the filled bottle 18.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A bottle opener, comprising, a base cap, for being received on a screw cap of a filled bottle to remove said screw cap, an empty bottle engaged with said base cap, providing handle and mechanical advantage means for unscrewing said screw cap of from said filled bottle, and a locking band received in said base cap, for securing said empty bottle to said base cap.

2. A bottle opener device as set forth in claim 1, wherein an opening in a bottom portion of said base cap is provided with left hand threads that engage with threads provided on the outer periphery of said screw cap of said filled bottle, and a transverse opening is provided in an upper portion of said base cap and freely receives said locking band.

3. A bottle opener device as set forth in claim 2, wherein a transverse recess in a top surface of said base cap, engages with an outer periphery of a bottom portion of said empty bottle and prevents lateral movement of said empty bottle, and said locking band engages with said outer periphery of said empty bottle.

4. A bottle opener device as set forth in claim 3, wherein a locking mechanism provided on one end of said locking band, provides tightening means for said band on said empty bottle when another end is pulled through said locking mechanism.

* * * * *